US007114415B1

(12) United States Patent
Chiang

(10) Patent No.: US 7,114,415 B1
(45) Date of Patent: Oct. 3, 2006

(54) CONTROL DEVICE FOR RATCHET TOOL

(75) Inventor: Shui Lai Chiang, Taichung (TW)

(73) Assignee: William Tools Co., Ltd., Taichung (TW)

( * ) Notice: Subject to any disclaimer, the term of this patent is extended or adjusted under 35 U.S.C. 154(b) by 0 days.

(21) Appl. No.: 11/250,838

(22) Filed: Oct. 14, 2005

(51) Int. Cl.
*B25B 13/46* (2006.01)

(52) U.S. Cl. ..... 81/63.2; 81/60; 81/63.1

(58) Field of Classification Search ..... 81/63.2, 81/60–63.1
See application file for complete search history.

(56) References Cited

U.S. PATENT DOCUMENTS 6,260,449 B1 7/2001 I-He
6,282,991 B1 9/2001 Hu
6,382,052 B1 * 5/2002 Chen ..... 81/63
6,435,062 B1 * 8/2002 McCann ..... 81/63.2
6,435,063 B1 * 8/2002 Chen ..... 81/63.2
6,647,832 B1 * 11/2003 Hu ..... 81/63.2
6,766,716 B1 * 7/2004 Lee ..... 81/60
6,959,626 B1 * 11/2005 Shen ..... 81/63.2
6,988,429 B1 * 1/2006 Lee et al. ..... 81/63.2

* cited by examiner

*Primary Examiner*—Lee D. Wilson
*Assistant Examiner*—Alvin J. Grant
(74) *Attorney, Agent, or Firm*—Charles E. Baxley

(57) ABSTRACT

A ratchet tool includes a handle having a chamber formed in a head for rotatably receiving a drive member which includes a gear, a pawl is received within the handle and includes two end portions for engaging with the gear of the drive member, to control driving directions of the drive member by the head of the handle. A pawl actuating member is rotatably received in the handle and includes a channel for slidably receiving an actuator. A spring may bias either of the end portions of the pawl to selectively engage with the gear, and to control the driving directions of the drive member by the handle. The actuator includes an actuating finger for engaging with either of two protrusions extended from the pawl.

7 Claims, 6 Drawing Sheets

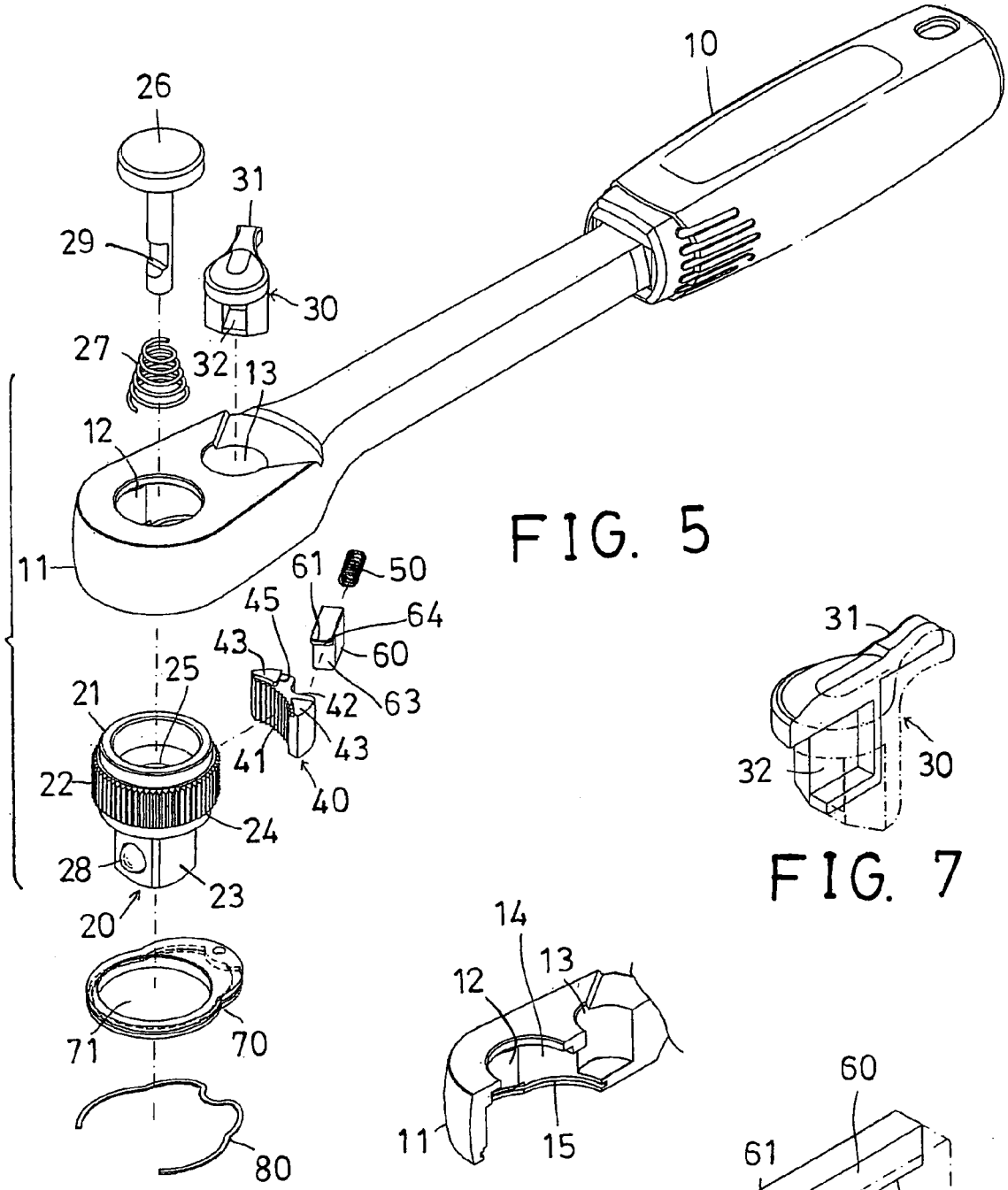
FIG. 5
FIG. 7
FIG. 6
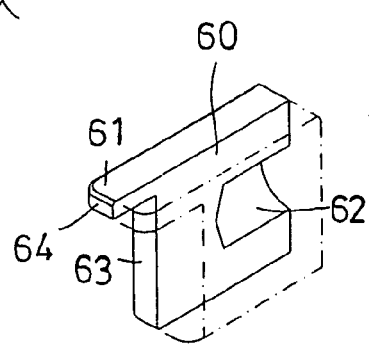
FIG. 8

CONTROL DEVICE FOR RATCHET TOOL

BACKGROUND OF THE INVENTION

1. Field of the Invention

The present invention relates to a ratchet tool, and more particularly to a ratchet tool having a control device for effectively controlling or actuating a pawl to engage with a drive member, and for preventing the pawl from being moved or disengaged from the drive member inadvertently.

2. Description of the Prior Art

Typical ratchet tools comprise a drive member rotatably received within a head and having an engaging hole formed therein for receiving and for driving fasteners, or having a driving shank extended therefrom for engaging with and for driving the fasteners, and a pawl pivotally received or engaged within the head or the handle, and biased to engage with the drive member, in order to control the driving or rotating directions of the drive member relative to the fasteners.

For example, U.S. Pat. No. 6,260,449 to I-He discloses one of the typical ratchet tools also comprising a pawl pivotally received or engaged within a head or a handle, and biased to engage with a drive member which is rotatably received within the head, and arranged to allow the pawl either to actuate the drive member to rotate or to drive the fasteners, or to allow the fasteners to be freely rotated reversely relative to the drive member.

For actuating the pawl, a pawl actuating member is further required to be provided and pivotally received or engaged within the handle, and a spring-biased ball engaged with the pawl, in order to actuate or to force either of two end portions of the pawl to engage with the drive member, and thus to control or to determine the driving or rotating directions of the drive member relative to the fasteners.

However, a spring member is required to be disposed between the spring-biased ball and the pawl actuating member, and the spring-biased ball may have a good chance to be disengaged from the pawl actuating member, and thus may not be used to engage with and to control the drive member.

U.S. Pat. No. 6,282,991 to Hu discloses another typical ratchet tool also comprising a pawl actuating member rotatably or pivotally received or engaged within the handle, and a spring member engaged with a pawl or engaged between the pawl and the pawl actuating member, for actuating or forcing the pawl to engage with the drive member, and thus to control or to determine the driving or rotating directions of the drive member relative to the fasteners.

In Hu, the spring member includes a flexible end for directly engaging with the pawl and for actuating the pawl to engage with the drive member, in order to actuate the drive member to rotate or to drive the fasteners, or to allow the fasteners to be freely rotated reversely relative to the drive member.

However, the flexible spring member may be curved or bent relative to the pawl actuating member and the pawl, and thus may not be used to effectively actuate the pawl to engage with and to control the drive member when the pawl actuating member is rotated relative to the pawl and the drive member.

The present invention has arisen to mitigate and/or obviate the afore-described disadvantages of the conventional control devices for ratchet tools.

SUMMARY OF THE INVENTION

The primary objective of the present invention is to provide a ratchet tool including a control device for effectively controlling or actuating a pawl to engage with a drive member, and for preventing the pawl from being moved or disengaged from the drive member inadvertently.

In accordance with one aspect of the invention, there is provided a ratchet tool comprising a handle including a head provided on one end thereof, and having a chamber formed therein, and including a compartment formed therein and spaced away from the chamber of the head, and including a space formed therein and located between and communicating with the chamber and the compartment thereof, a drive member rotatably received within the chamber of the head, and including a gear provided on an outer peripheral portion thereof, a pawl pivotally received within the space of the handle, and including two end portions for selectively engaging with the gear of the drive member, in order to control driving directions of the drive member by the head of the handle, a pawl actuating member rotatably received within the compartment of the handle, and including a knob extended therefrom for being actuated by a user, and including a channel formed therein, an actuator slidably received in the channel of the pawl actuating member, and arranged to be rotated relative to the pawl and the head by the pawl actuating member, and arranged for preventing the actuator from being disengaged from the pawl actuating member, and a spring member engaged between the pawl actuating member and the actuator, for biasing the actuator to engage with the pawl, and for forcing either of the end portions of the pawl to selectively engage with the gear of the drive member, and to control the driving directions of the drive member by the head of the handle.

The pawl includes a recess formed therein and defined by two surfaces, and the actuator is biased to engage with either of the surfaces of the pawl, for allowing the actuator to be stably engaged with the pawl, and for stably forcing either of the end portions of the pawl in engagement with the gear of the drive member. The actuator includes a surface formed in a front portion thereof, for selectively engaging with either of the surfaces of the pawl, and thus for stably engaging with the pawl, in order to stably force either of the end portions of the pawl in engagement with the gear of the drive member.

The pawl includes two protrusions extended therefrom, and the actuator includes an actuating finger extended therefrom for engaging onto the pawl, and for engaging with either of the protrusions of the pawl, so as to further stably engage with the pawl. The protrusions of the pawl each preferably includes a surface formed therein, for stably engaging with the actuating finger of the actuator. The actuator includes a cavity formed therein, for partially and stably receiving the spring member.

The channel of the pawl actuating member preferably includes a non-circular cross section, and the actuator includes a similar non-circular cross section for engaging with the corresponding non-circular channel of the pawl actuating member, and for stably guiding the actuator to slide relative to the pawl actuating member, and for preventing the actuator from being rotated relative to the pawl actuating member.

The drive member includes a bore formed therein, a driving shank extended therefrom, a ball slidably received in the driving shank of the drive member, and an actuating stem slidably received within the bore of the drive member and having an actuator provided therein for being biased to engage with the ball, and for selectively forcing the ball to extend out of the driving shank, to selectively engage with fasteners or the like.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 5 is an exploded view of the ratchet tool;

FIGS. 6, 7, 8 are enlarged partial perspective views illustrating the head and the pawl actuating device of the ratchet tool respectively;

DETAILED DESCRIPTION OF THE PREFERRED EMBODIMENT

Figure 1:
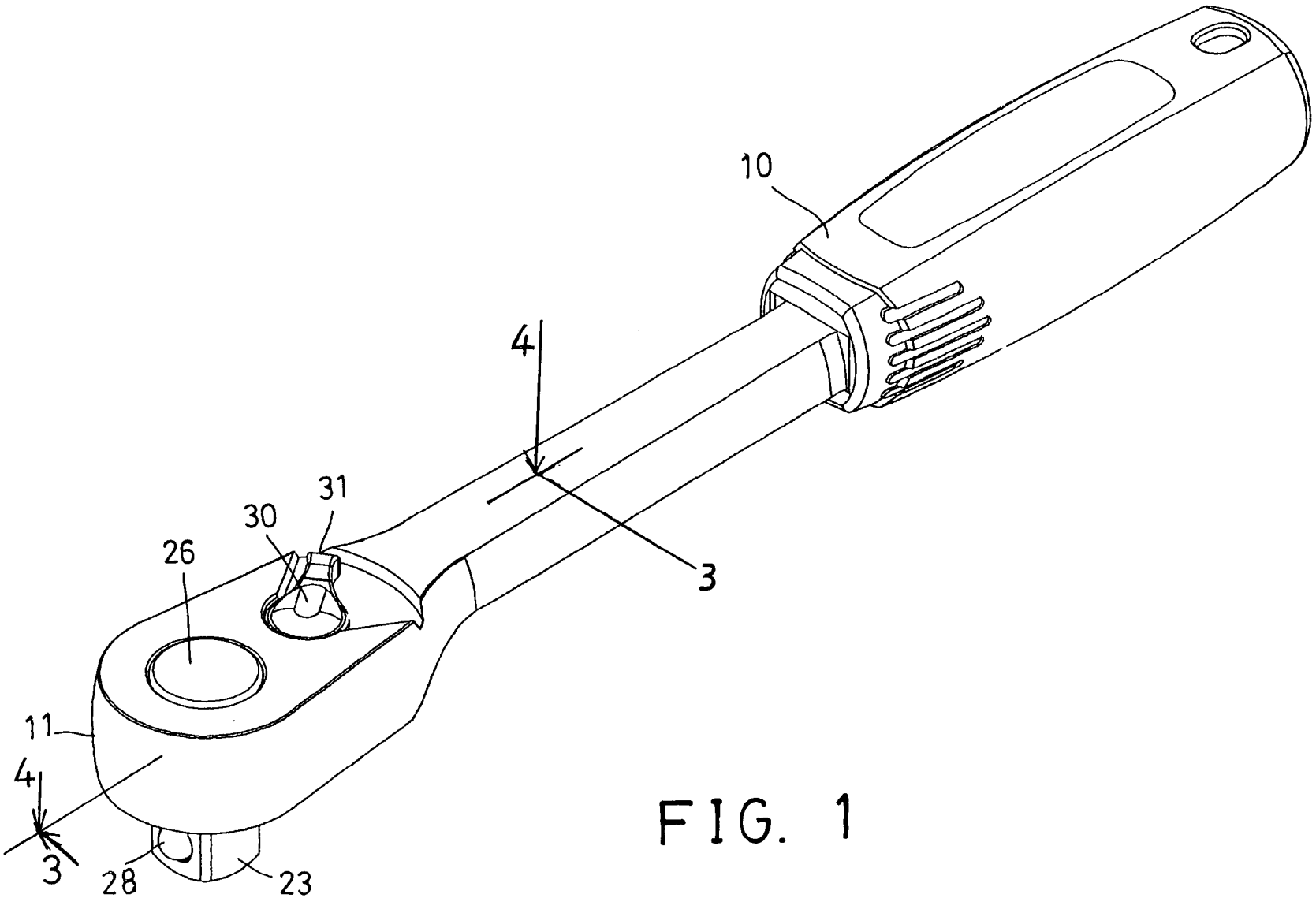
FIG. 1 is a perspective view of a ratchet tool in accordance with the present invention.
Figure 2:
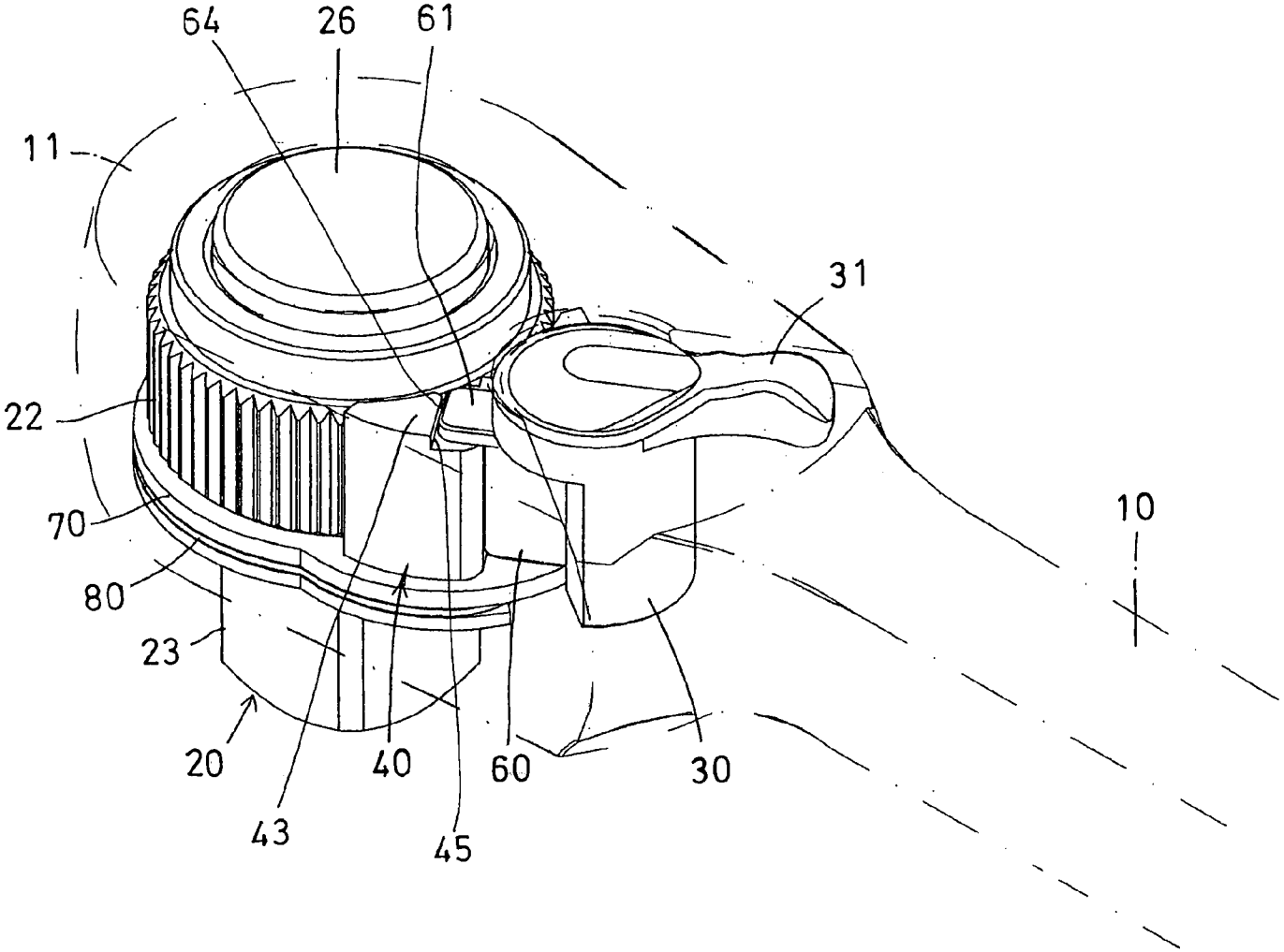
FIG. 2 is a partial perspective view of the ratchet tool.

Referring to the drawings, and initially to FIGS. 1–6, a ratchet tool in accordance with the present invention comprises a handle 10 including a head 11 formed or provided on one end thereof and having a chamber 12 formed therein for rotatably receiving a drive member 20 therein. The handle 10 further includes a compartment 13 formed therein and spaced away from the chamber 12 of the head 11, for rotatably receiving a pawl actuating member 30 therein, and includes a space 14 formed therein and located between and communicating with the chamber 12 and the compartment 13 thereof, for pivotally receiving a pawl 40 therein.

The drive member 20 includes a peripheral shoulder 21 formed or provided in the upper portion thereof, for rotatably engaging with the head 11 of the handle 10, and for preventing the drive member 20 from being disengaged from the head 11 of the handle 10 via the upper portion of the chamber 12 of the head 11 of the handle 10, and includes a peripheral gear 22 formed or provided on the outer peripheral portion thereof, and includes a driving shank 23 extended therefrom for engaging with and for driving the fasteners or the like (not shown), and includes another peripheral shoulder 24 formed or provided in the lower portion thereof.

A cover 70 may be attached or secured to the bottom portion of the head 11 of the handle 10, and engaged with a lower peripheral shoulder 15 which is formed or provided in the lower portion of the head 11 of the handle 10, and secured to the lower portion of the head 11 of the handle 10 with such as a clamping or retaining ring 80, for enclosing the chamber 12 and the space 14 of the handle 10, and for stably retaining the drive member 20 and the pawl 40 within the handle 10. The cover 70 includes an opening 71 formed therein for rotatably receiving the driving shank 23 of the drive member 20, and the peripheral shoulder 24 of the drive member 20 may be engaged with the cover 70, for allowing the drive member 20 to be stably retained within the handle 10.

Figure 3:
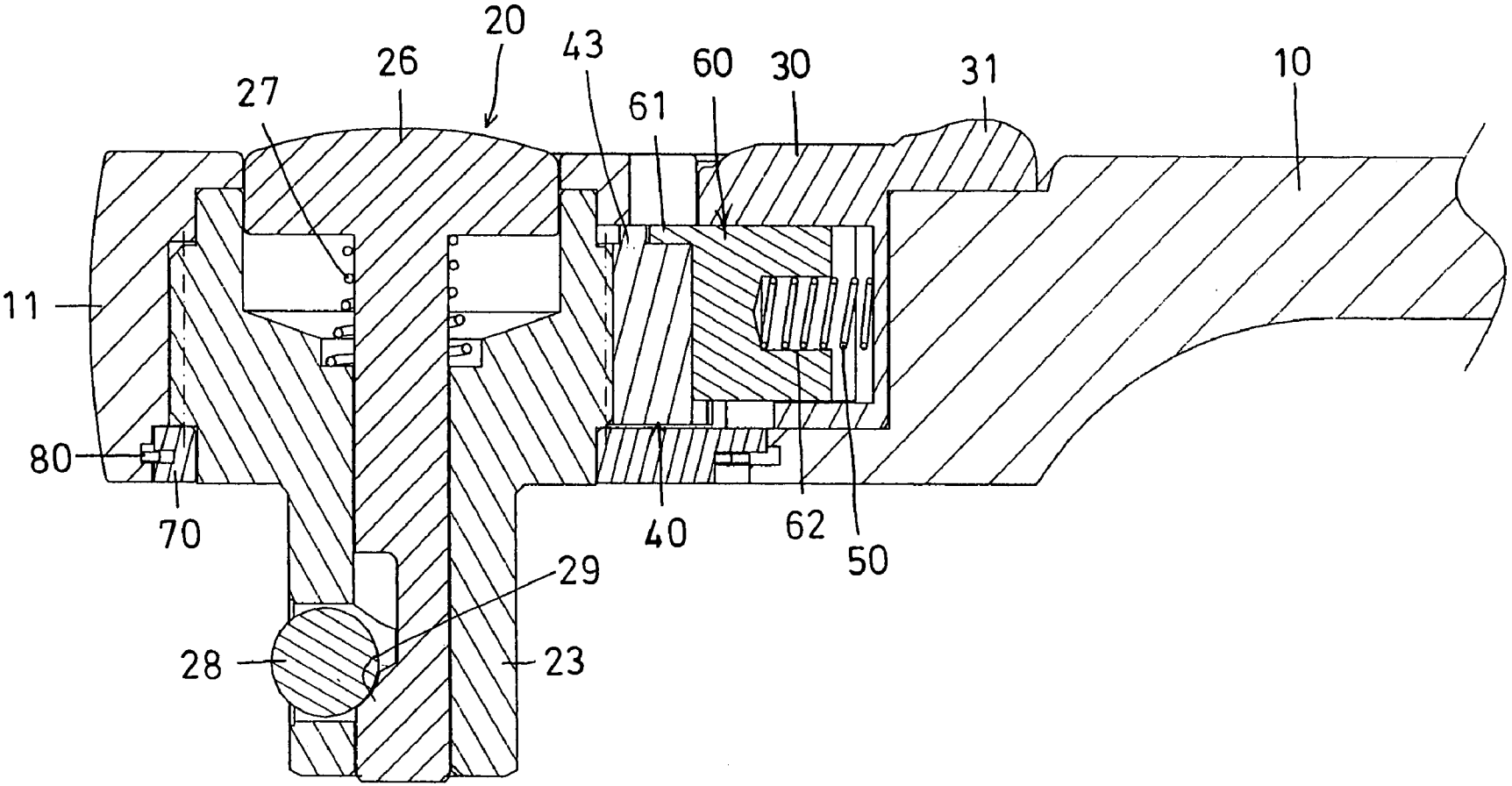
FIG. 3 is a partial cross sectional view of the ratchet tool, taken along lines 3—3 of FIG. 1.

The drive member 20 further includes a bore 25 formed therein for slidably receiving an actuating stem 26 therein, and the actuating stem 26 includes an actuator 29 formed or provided therein for engaging with a ball 28 that is slidably received in the driving shank 23 of the drive member 20, and that is partially extendible out of the driving shank 23 of the drive member 20 (FIGS. 1, 3). The ball 28 may be selectively forced to partially extend out of the driving shank 23 of the drive member 20 by the actuator 29 of the actuating stem 26 (FIG. 3) when the actuating stem 26 is slid or moved relative to the drive member 20.

A spring member 27 may be engaged with the actuating stem 26, and the actuator 29 of the actuating stem 26 may be engaged with the ball 28, for forcing the ball 28 to partially extend out of the driving shank 23 of the drive member 20 and to engage with the fasteners or the like (not shown), and to selectively anchor the fasteners to the driving shank 23 of the drive member 20. The ball 28 may be moved into the driving shank 23 of the drive member 20 when the ball 28 is disengaged from the actuator 29 of the actuating stem 26 and when the actuating stem 26 is depressed or actuated against the spring member 27.

The pawl 40 includes two end teeth or two end portions 41 for selectively engaging with the peripheral gear 22 of the drive member 20, in order to selectively engaging the head 11 of the handle 10 with the drive member 20, and so as to control or to determine the driving or rotating directions of the drive member 20 by the head 11 of the handle 10, relative to the fasteners. The engagement of the end teeth or end portions 41 of the pawl 40 with the peripheral gear 22 of the drive member 20 is typical and will not be described in further details.

Figure 4:
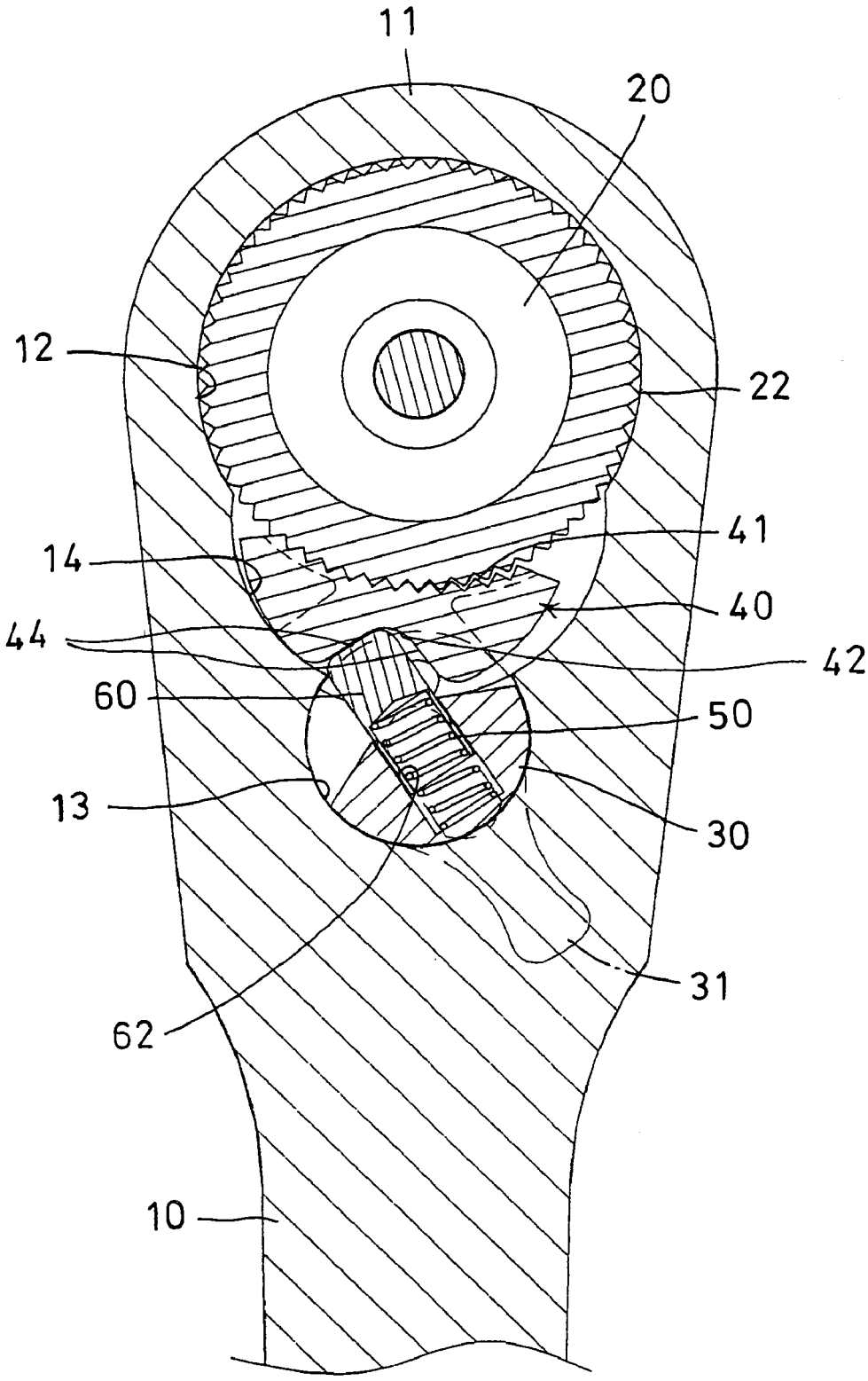
FIG. 4 is another partial cross sectional view of the ratchet tool, taken along lines 4—4 of FIG. 1.
Figure 10:
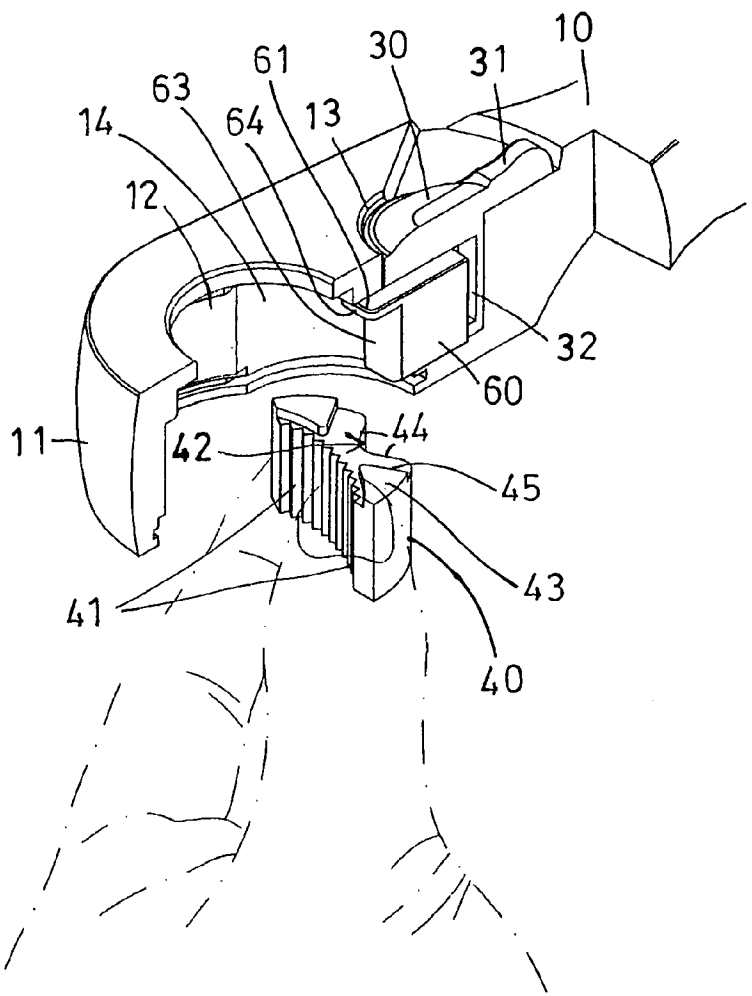
FIG. 10 is an enlarged partial exokided view illustrating the assembling operation of the ratchet tool.

The pawl 40 includes a substantially curved or V-shaped recess 42 formed therein and defined by two surfaces 44, best shown in FIGS. 4 and 10, and further includes two protrusions 43 extended upwardly therefrom, such as extended upwardly from the end portions 41 thereof respectively, and each having a surface 45 (FIGS. 5, 10) formed therein. The pawl actuating member 30 is rotatably received within the compartment 13 of the handle 10, and includes a knob 31 extended therefrom and extendible outwardly through the compartment 13 of the handle 10, for being actuated or rotated by the user.

The pawl actuating member 30 further includes a channel 32 formed therein, such as a non-circular channel 32 formed therein, or preferably having a non-circular cross section, and facing toward the pawl 40, for slidably receiving an actuator 60 which is also non-circular or which includes a non-circular cross section for engaging with the corresponding non-circular channel 32 of the pawl actuating member 30, and for allowing the actuator 60 to be stably guided to slide or to move relative to the pawl actuating member 30, and for preventing the actuator 60 from being rotated relative to the pawl actuating member 30.

The actuator 60 includes an actuating finger 61 extended therefrom, such as extended forwardly from the upper portion thereof, for engaging over or onto the pawl 40 (FIG. 2), and for engaging with either of the protrusions 43 of the pawl 40. Another spring member 50 may be engaged between the pawl actuating member 30 and the actuator 60, such as partially and stably received within a cavity 62 (FIG. 8) of the actuator 60 (FIGS. 3, 4), for biasing or forcing the actuator 60 to engage with the pawl 40, and for biasing or forcing the actuating finger 61 of the actuator 60 to engage with the protrusions 43 of the pawl 40.

It is preferable that the actuator 60 includes a flat or slightly curved surface 63 formed in the front portion thereof, for selectively engaging with either of the surfaces 44 of the pawl 40, and thus for stably engaging with the pawl 40, and thus for effectively forcing or actuating the end teeth or end portions 41 of the pawl 40 to selectively engage with the peripheral gear 22 of the drive member 20, and for preventing the end teeth or end portions 41 of the pawl 40 from being disengaged from the peripheral gear 22 of the drive member 20.

It is also preferable that the actuator 60 further includes a flat or slightly curved surface 64 formed in the front portion of the actuating finger 61, for selectively engaging with the surface 45 of either of the protrusions 43 of the pawl 40, and for further stably engaging with the pawl 40, and thus for effectively forcing or actuating the end teeth or end portions 41 of the pawl 40 to selectively engage with the peripheral gear 22 of the drive member 20.

Figure 9:
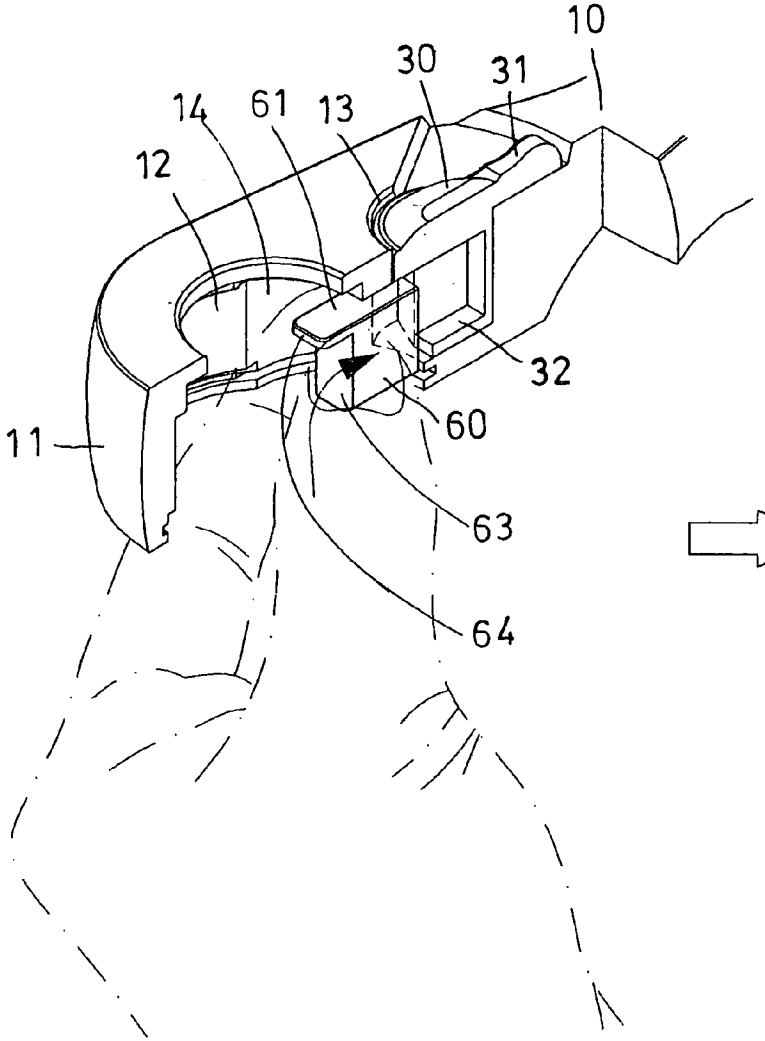
FIG. 9 is an enlarged partial perspective view illustrating the operation of the ratchet tool.

In assembling the ratchet tool, as shown in FIG. 9, the pawl actuating member 30 may first be rotatably engaged into the compartment 13 of the handle 10, and to have the knob 31 extended outwardly through the compartment 13 of the handle 10, the actuator 60 may then be easily and slidably engaged into the corresponding non-circular channel 32 of the pawl actuating member 30, for stably guiding the actuator 60 to slide or to move relative to the pawl actuating member 30. The pawl 40 may then be easily engaged into the space 14 of the handle 10, to have the surfaces 44 thereof to engage with the surface 63 of the actuator 60.

The prior or conventional ratchet tools fail to provide an actuator 60 which is slidably engaged into the corresponding channel 32 of the pawl actuating member 30, for allowing the actuator 60 to be rotated or moved relative to the pawl 40 and the head 11 by the pawl actuating member 30, and for preventing the actuator 60 from being rotated relative to the pawl actuating member 30, and for preventing the actuator 60 from being disengaged from the pawl actuating member 30. The actuator 60 further includes an actuating finger 61 for engaging over or onto the pawl 40 and for engaging with either of the protrusions 43 of the pawl 40, and for further effectively controlling or actuating the actuator 60 to engage with the pawl 40.

Accordingly, the ratchet tool in accordance with the present invention includes a control device for effectively controlling or actuating the pawl to engage with the drive member, and for preventing the pawl from being moved or disengaged from the drive member inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a handle including a head provided on one end thereof, and having a chamber formed therein, and including a compartment formed therein and spaced away from said chamber of said head, and including a space formed therein and located between and communicating with said chamber and said compartment thereof, a drive member rotatably received within said chamber of said head, and including a gear provided on an outer peripheral portion thereof, a pawl pivotally received within said space of said handle, and including two end portions for selectively engaging with said gear of said drive member, in order to control driving directions of said drive member by said head of said handle, a pawl actuating member rotatably received within said compartment of said handle, and including a knob extended therefrom for being actuated by a user, and including a channel formed therein, and including two protrusions extended therefrom, an actuator slidably received in said channel of said pawl actuating member, and arranged to be rotated relative to said pawl and said head by said pawl actuating member, and said actuator including an actuating finger extended therefrom for engaging onto said pawl, and for engaging with either of said protrusions of said pawl, and a spring member engaged between said pawl actuating member and said actuator, for biasing said actuator to engage with said pawl, and for forcing either of said end portions of said pawl to selectively engage with said gear of said drive member, and to control the driving directions of said drive member by said head of said handle.

2. The ratchet tool as claimed in claim 1, wherein said pawl includes a recess formed therein and defined by two surfaces, and said actuator is biased to engage with either of said surfaces of said pawl, for stably forcing either of said end portions of said pawl in engagement with said gear of said drive member.

3. The ratchet tool as claimed in claim 2, wherein said actuator includes a surface formed in a front portion thereof, for selectively engaging with either of said surfaces of said pawl, to stably force either of said end portions of said pawl in engagement with said gear of said drive member.

4. The ratchet tool as claimed in claim 1, wherein said protrusions of said pawl each includes a surface formed therein, for stably engaging with said actuating finger of said actuator.

5. The ratchet tool as claimed in claim 1, wherein said actuator includes a cavity formed therein, for partially and stably receiving said spring member.

6. The ratchet tool as claimed in claim 1, wherein said channel of said pawl actuating member includes a non-circular cross section, and said actuator includes a non-circular cross section for engaging with said corresponding non-circular cross section of said channel of said pawl actuating member, and for guiding said actuator to slide relative to said pawl actuating member, and for preventing said actuator from being rotated relative to said pawl actuating member.

7. The ratchet tool as claimed in claim 1, wherein said drive member includes a bore formed therein, a driving shank extended therefrom, a ball slidably received in said driving shank of said drive member, and an actuating stem slidably received within said bore of said drive member and having an actuator provided therein for engaging with said ball, and for selectively forcing said ball to extend out of said driving shank.

* * * * *